US011008987B2

(12) United States Patent
Cotton et al.

(10) Patent No.: US 11,008,987 B2
(45) Date of Patent: May 18, 2021

(54) VENTURI FLUID PUMP WITH OUTLET FLOW CONTROLLER

(71) Applicant: WALBRO ENGINE MANAGEMENT, L.L.C., Tucson, AZ (US)

(72) Inventors: Kenneth J. Cotton, Caro, MI (US); Elton J. Fisch, Caro, MI (US); David D. Hacker, Bad Axe, MI (US); Jeffrey D. Hanby, Cass City, MI (US); Kevin L. Israelson, Cass City, MI (US); Roger N. Smith, Lapeer, MI (US)

(73) Assignee: WALBRO LLC, Tucson, AZ (US)

( * ) Notice: Subject to any disclaimer, the term of this patent is extended or adjusted under 35 U.S.C. 154(b) by 1047 days.

(21) Appl. No.: 14/190,629

(22) Filed: Feb. 26, 2014

(65) Prior Publication Data

US 2014/0239097 A1 Aug. 28, 2014

Related U.S. Application Data

(60) Provisional application No. 61/769,385, filed on Feb. 26, 2013.

(51) Int. Cl.

| | |
|---|---|
| ***F02M 37/20*** | (2006.01) |
| ***F02M 37/10*** | (2006.01) |
| ***F02M 37/00*** | (2006.01) |

(52) U.S. Cl.

CPC ..... *F02M 37/20* (2013.01); *F02M 37/103* (2013.01); *F02M 37/007* (2013.01)

(58) Field of Classification Search

CPC ..... F04F 5/02; F04F 5/10; F04F 5/48; F04F 5/50; F04F 5/54; F02M 37/02; F02M 37/025; F02M 37/0011; F02M 37/0076; F02M 37/0017; F02M 37/0047; F02M 37/0082; F02M 37/20; F02M 37/103; F02M 37/007

USPC ..... 417/185, 192, 193

See application file for complete search history.

(56) References Cited

U.S. PATENT DOCUMENTS

| | | | | |
|---|---|---|---|---|
| 224,762 A * | 2/1880 | Bancroft | F04F 5/32 417/193 |
| 284,614 A * | 9/1883 | Colvin | F04F 5/461 417/185 |
| 302,543 A * | 7/1884 | Colvin | F04F 5/468 417/168 |
| 5,427,074 A | 6/1995 | Tuckey | |
| 6,155,793 A | 12/2000 | Tuckey et al. | |
| 6,213,726 B1 * | 4/2001 | Tuckey | B01D 35/027 417/199.1 |

(Continued)

*Primary Examiner* — Bryan M Lettman

(74) *Attorney, Agent, or Firm* — Reising Ethington P.C.

(57) ABSTRACT

A fuel pump for a fuel system includes a nozzle, a venturi, a pump inlet and a flow controller. The nozzle has an orifice through which fuel is ejected and the venturi is downstream of the nozzle and has an inlet through which fuel discharged from the orifice flows, a passage downstream of the venturi inlet through which fuel flows to create a drop in pressure in the area of the venturi, and an outlet through which fuel is discharged from the venturi. Fuel is drawn through the pump inlet by the drop in the pressure created in the area of the venturi and the flow controller is downstream of the outlet and has a chamber in which fuel from the venturi outlet is received. The flow controller causes fuel to fill the venturi to ensure performance of the fuel pump.

15 Claims, 3 Drawing Sheets

(56) References Cited

U.S. PATENT DOCUMENTS

| | | | | |
|---|---|---|---|---|
| 6,269,800 | B1 * | 8/2001 | Fischerkeller | B60K 15/077 123/514 |
| 6,792,923 | B2 * | 9/2004 | Kumagai | F02M 37/025 123/494 |
| 7,913,670 | B2 * | 3/2011 | Holtz | F02M 37/0094 123/509 |
| 2004/0011336 | A1 * | 1/2004 | Finch | F02M 37/025 123/509 |
| 2006/0231079 | A1 * | 10/2006 | Paluszewski | F02M 37/106 123/514 |
| 2010/0139778 | A1 * | 6/2010 | Kato | F02D 33/003 137/14 |
| 2012/0018019 | A1 * | 1/2012 | Martin | F02M 37/025 137/565.22 |
| 2013/0047966 | A1 * | 2/2013 | Mason | F02M 37/0088 123/509 |

* cited by examiner

VENTURI FLUID PUMP WITH OUTLET FLOW CONTROLLER

This application claims the benefit of U.S. Provisional Application No. 61/769,385 filed Feb. 26, 2013, which is incorporated herein by reference in its entirety.

TECHNICAL FIELD

The present disclosure relates generally to a fluid pump with a venturi and an outlet flow controller.

BACKGROUND

Fuel pump assemblies typically include a motor driven fuel pump that takes in fuel from a tank and discharges the fuel under pressure. Some of these fuel pumps are disposed within the tank, and further within a reservoir that is received within the tank. To move fuel from the tank interior to the reservoir interior so that fuel is readily available to the fuel pump therein, a secondary pump may be used. Secondary pumps have included so-called "jet pumps" having a nozzle and venturi through which fuel is directed to create a pressure drop that causes fuel to flow.

SUMMARY

A fuel pump for a fuel system includes a nozzle, a venturi, a pump inlet and a flow controller. The nozzle has an orifice through which fuel is ejected and the venturi is downstream of the nozzle and has an inlet through which fuel discharged from the orifice flows, a passage downstream of the venturi inlet through which fuel flows to create a drop in pressure in the area of the venturi, and an outlet through which fuel is discharged from the venturi. Fuel is drawn through the pump inlet fuel by the drop in the pressure created in the area of the venturi and the flow controller is downstream of the outlet and has a chamber in which fuel from the venturi outlet is received. The flow controller causes fuel to fill the venturi to ensure efficient performance of the fuel pump.

A fuel pump assembly includes a fuel pump, a nozzle, a venturi and a flow controller. The fuel pump has an inlet through which fuel enters the fuel pump and an outlet through which fuel is discharged under pressure. The nozzle has an inlet in communication with the outlet of the fuel pump so that at least some of the fuel discharged from the fuel pump outlet flows into the nozzle inlet, and the nozzle also has an orifice through which fuel is ejected from the nozzle. The venturi is downstream of the nozzle and has an inlet through which fuel discharged from the orifice flows, a passage downstream of the inlet through which fuel flows to create a drop in pressure, and an outlet through which fuel is discharged from the venturi. And a flow controller is downstream of the venturi outlet so that at least some of the fuel discharged from the venturi outlet is directed to wet the venturi outlet with fuel and thereby improve the pressure drop generated in the area of the venturi.

In at least some implementations, the flow controller includes a wall that is not parallel to an axis of the venturi and fluid flow out of the venturi outlet. Fuel discharged from the venturi outlet engages the wall and backs up in the flow controller or otherwise causes fuel to wet the venturi, preferably an entire region or cross-sectional area of the venturi to fully wet at least a section of the venturi and prevent an air gap extending through the venturi which may decrease the efficiency of the pump. The flow controller may sufficiently wet the venturi and reduce or prevent an axially extending air gap in the venturi even at relatively low flow rates to ensure efficient operation of the fuel pump.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
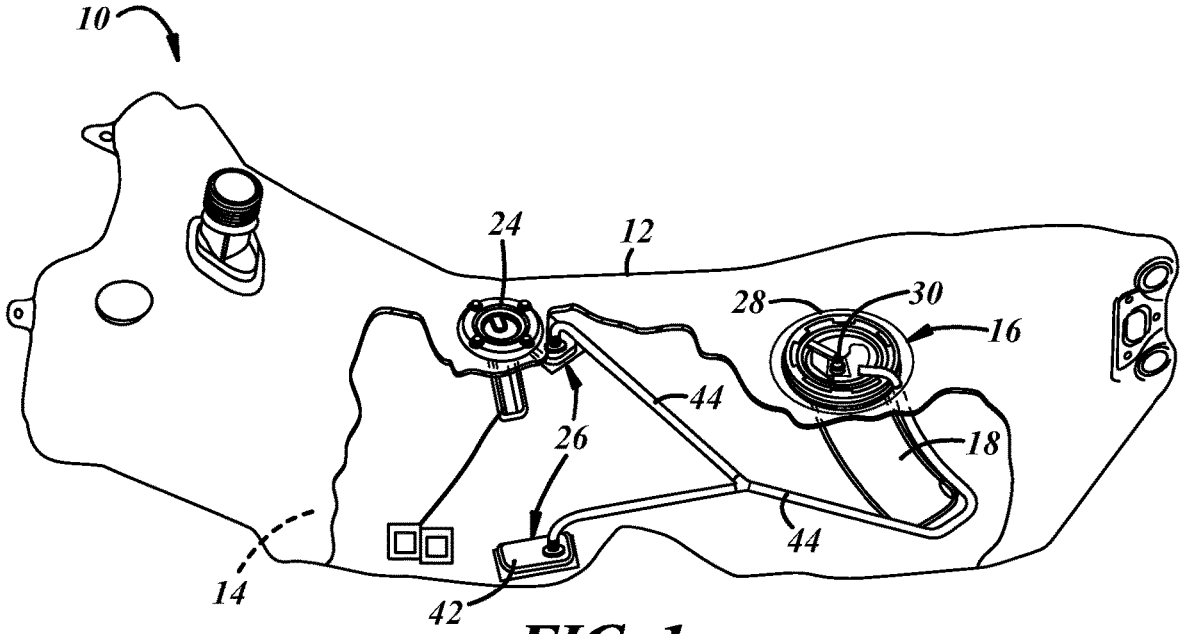
FIG. 1 is a perspective view of a fuel tank assembly including fuel delivery components carried by a fuel tank.
Figure 2:
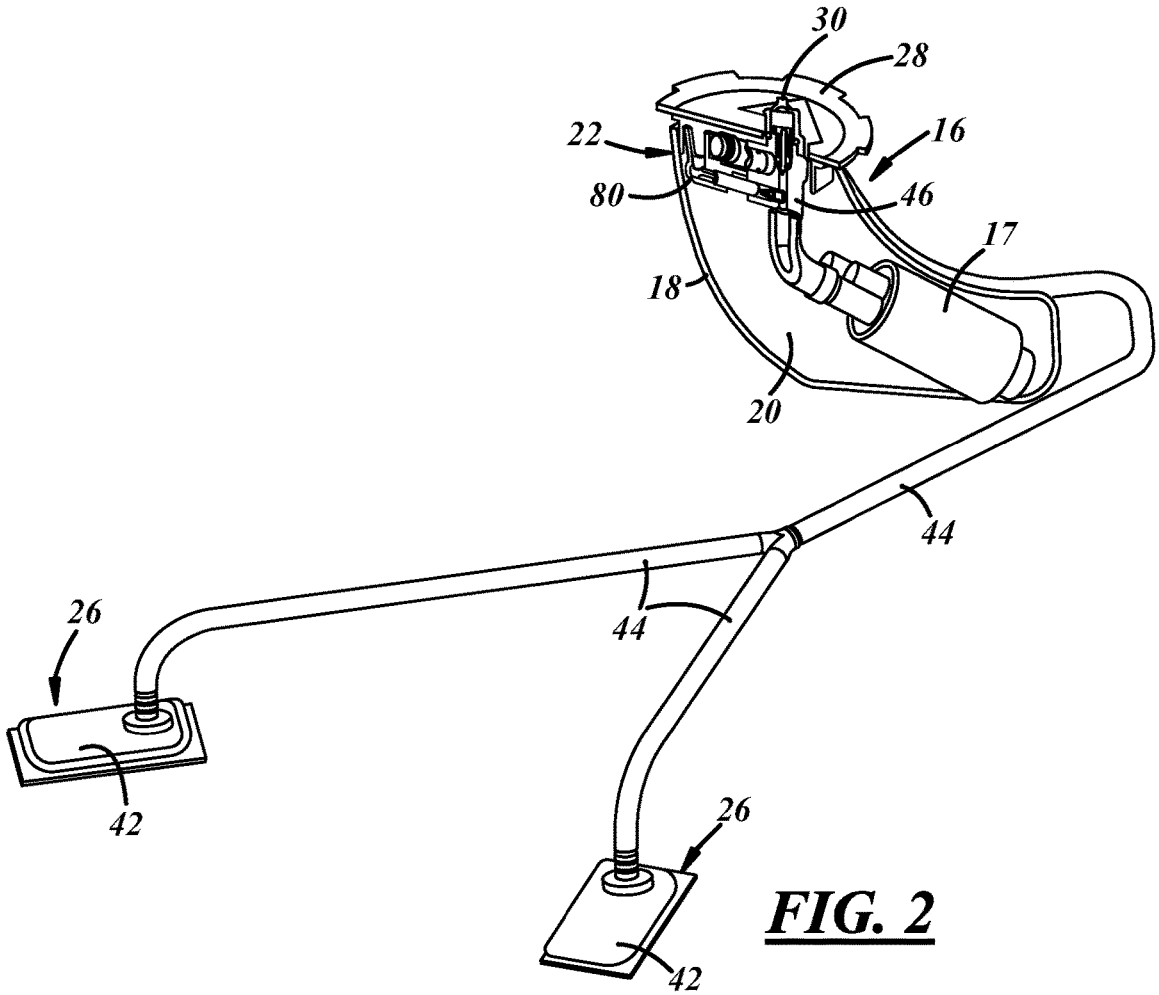
FIG. 2 is a perspective view of some of the fuel delivery components shown without the fuel tank.

Referring in more detail to the drawings, FIG. 1 illustrates a fuel tank assembly 10 including a fuel tank 12 and some fuel system components associated with or carried by the fuel tank. The fuel tank 12 has an interior 14 in which a supply of fuel may be maintained, and a fuel pump module 16 includes a main fuel pump 17 (FIG. 2) that pressurizes fuel from within the reservoir 18 and delivers it to an engine. To ensure a supply of fuel remains near an inlet of the fuel pump 17 even if the fuel in the tank 12 generally is sloshing around or by gravity flows away from the fuel pump, the module 16 may include a reservoir 18 that may contain a supply of fuel in its interior 20. The fuel pump 17 may be carried by the reservoir 18 with an inlet of the fuel pump communicated with the interior 20 of the reservoir 18. A fluid pump 22, such as a venturi pump, may be used as a secondary fuel pump to transfer fuel from the main tank 12 into the reservoir 18. As shown in FIGS. 1 and 2, the fuel tank assembly 10 may also include a fuel level sender 24 that provides an indication of the fuel level within the tank 12, and one or more fuel pickups 26 that aid in moving fuel to the reservoir 18 from locations in the tank that are outside of and may be remote from the reservoir.

As shown in FIGS. 1-5, the fuel pump module 16 includes a mounting flange 28 that may be sealed to the fuel tank 12 in assembly. The mounting flange 28 is coupled to or formed as part of the reservoir 18 such that the reservoir is carried by the flange. Also, the reservoir 18 may be independent of flange 28 and mounted separately. The flange 28 includes an outlet 30 through which fuel is discharged from the tank 12 for delivery to an engine, although the tank outlet could be separate from the flange, if desired. The flange 28 also has a depending annular skirt 32 to which a sidewall 34 of the reservoir 18 may be connected and by which other components, like a fuel pressure regulator 36, outlet check valve 38, and secondary fuel pump 22 may be carried, as will be described in more detail later.

As shown in FIGS. 2-5, the reservoir 18 may be a generally cylindrical body closed at one end and coupled to the flange 28 at its other end. The main fuel pump 17 may be received within the reservoir 18, may have a pumping mechanism driven by an electric motor, and may have an inlet in communication with the lower end of the reservoir. The reservoir 18 may be curved and generally C-shaped to angle and laterally space a lower portion of the reservoir away from the flange 28, which may be done to locate the lower end of the reservoir in a lower portion or sump of the fuel tank 12. Of course, the reservoir 18 can be any shape such as curved, cylindrical, straight, bowl shaped, box shaped, etc. One or more fill valves 40 (FIG. 4) may be carried by the reservoir 18 at or near its lower end and may function to allow fuel to flow into the reservoir but prevent fuel from flowing out of the reservoir and back into the tank 12. The fill valve 40 may be passive and thereby permit one-way flow of fuel into the reservoir 18 when the level of fuel outside of the fill valve 40 (and in which the valve is immersed) is greater than the level of fuel inside the reservoir 18. Even at times when the level of fuel in the fuel tank 12 is low, or when fuel has moved within the tank away from the reservoir 18, the fill valve 40 may hold a supply of fuel within the reservoir 18 so that fuel is available to the fuel pump 17.

To further provide fuel into the reservoir 18, one or more fuel pickups 26 may be located within the fuel tank 12, spaced from the reservoir 18. The fuel pickups 26 may each have an inlet filter 42 through which fuel may flow, and one or more conduits 44 may communicate the fuel pickups 26 with the interior 20 of the reservoir 18. The conduits 44 may also communicate the fuel pickups 26 with the secondary fuel pump 22 which provides a reduced pressure that is communicated through the conduits 44 with the fuel pickups 26 to move fuel from the pickups into the reservoir 18. This facilitates moving fuel from remote portions of the fuel tank 12 into the reservoir 18 and can aid in using more fuel in the tank before the fuel pump 17 runs dry even if the vehicle with which the tank 12 is used is on an incline where fuel in the tank is moved away from the reservoir inlet (e.g. fill valve 40).

Figure 3:
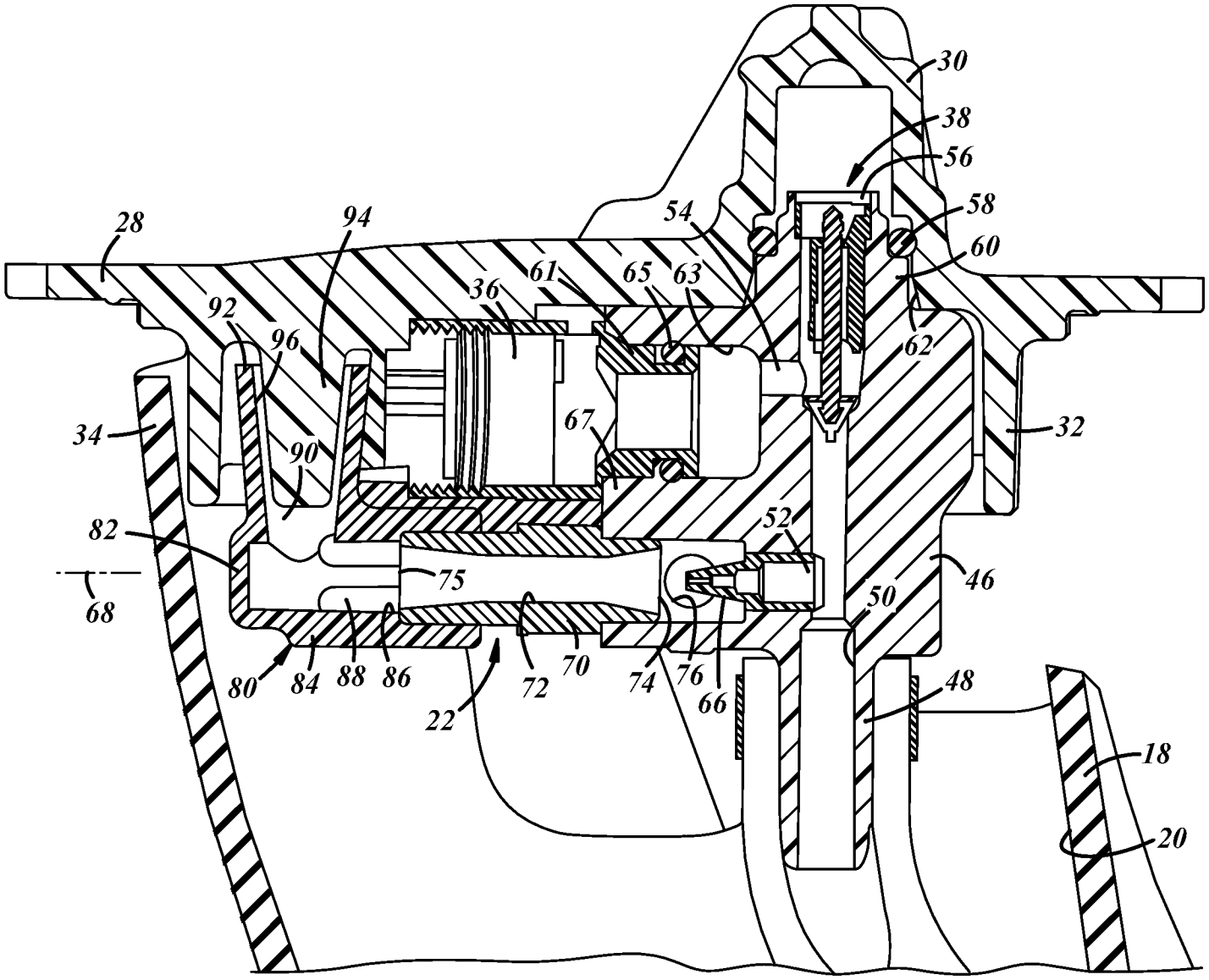
FIG. 3 is an enlarged, fragmentary, sectional view of a portion of a fuel pump module showing a secondary fuel pump.
Figure 4:
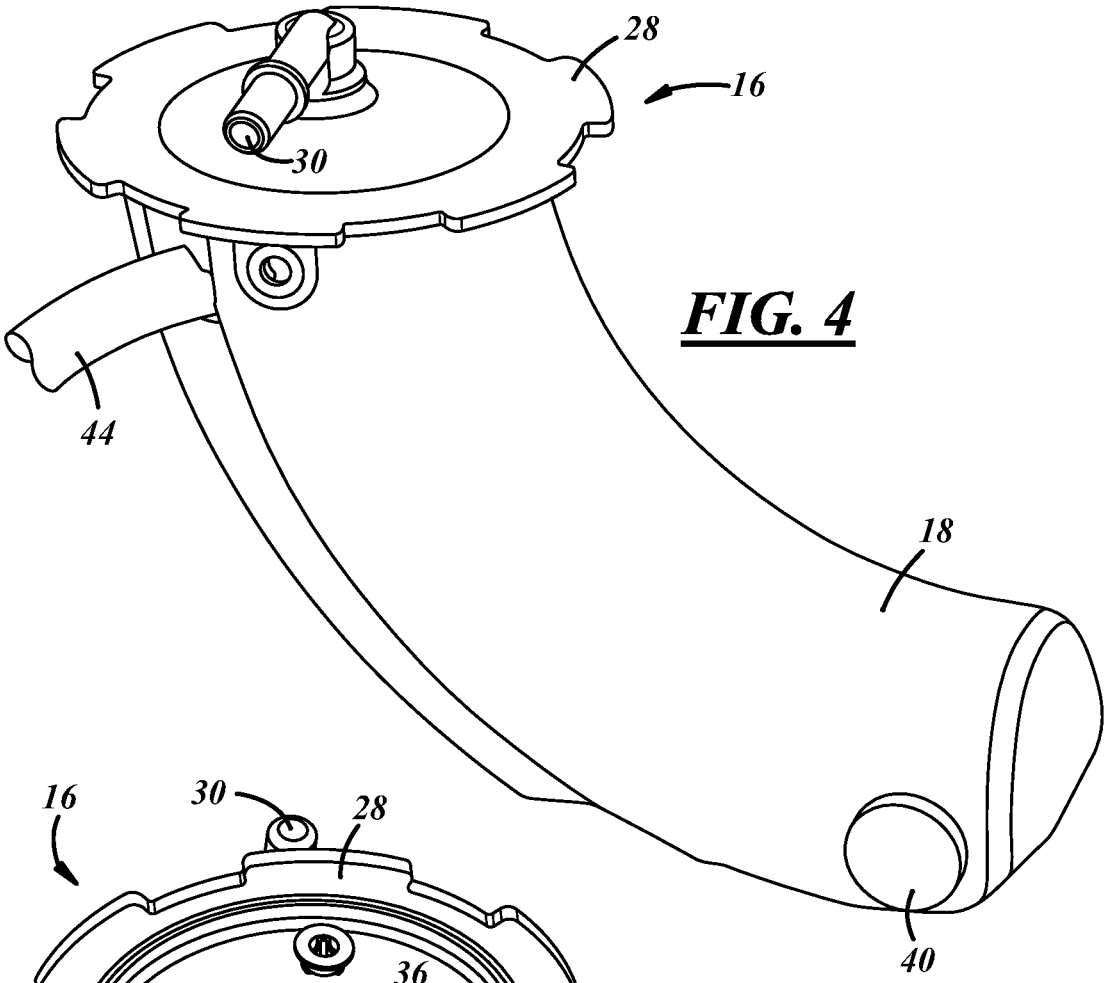
FIG. 4 is a perspective view of the fuel pump module.
Figure 5:
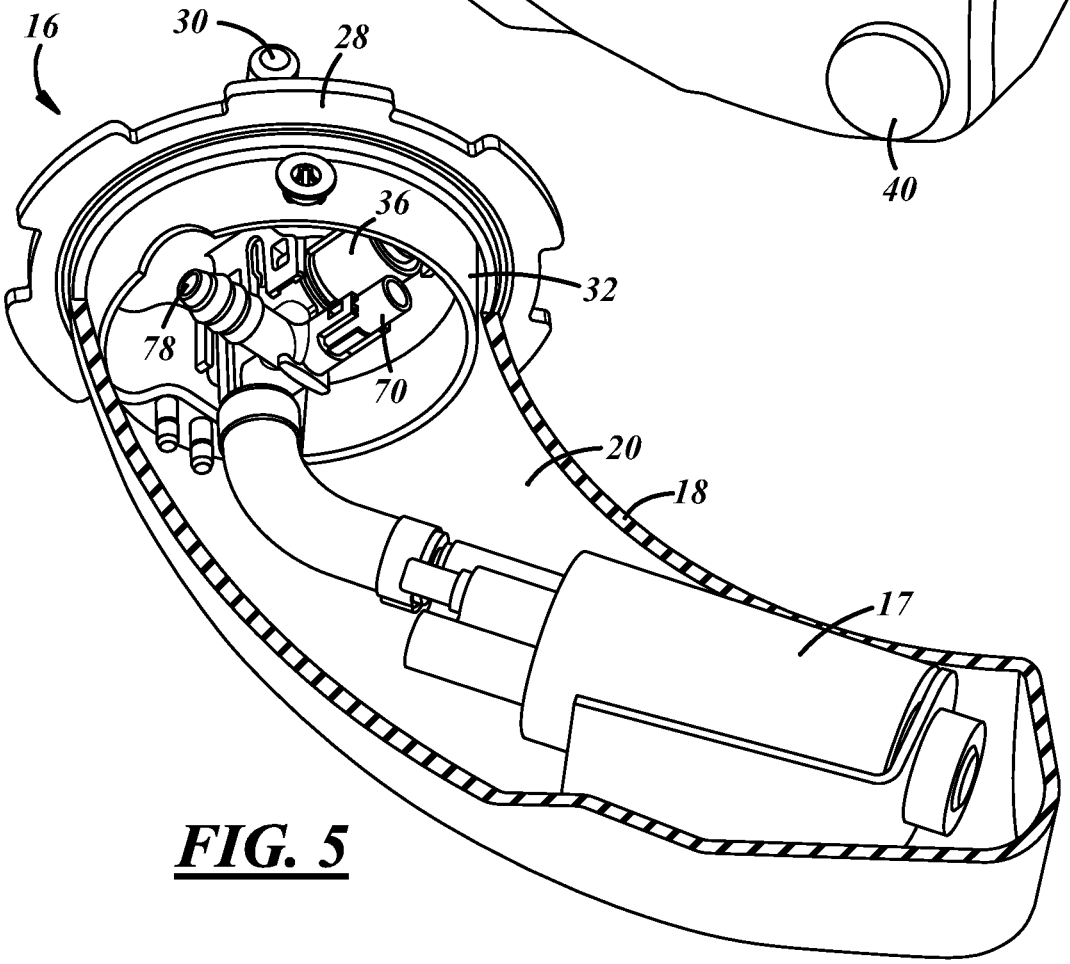
FIG. 5 is a perspective view of the fuel pump module with a portion of a reservoir cut away to show components therein.

As shown in FIGS. 3 and 4, the secondary fuel pump 22 may be carried by the module flange 28, such as in a housing 46 that is carried by or formed in one-piece with the flange. That is, the housing 46 and flange 28 could be two separate components that are mechanically coupled (e.g. press-fit, threads, some connector, and/or weld) or the housing 46 could be defined by integral features formed into the same piece of material as the flange 28 (e.g. the flange could be molded from plastic to include the features of the housing without requiring a separate body).

As shown in FIG. 3, the housing 46 includes an inlet 48 that is coupled to the outlet of the main fuel pump 17 so that fuel discharged under pressure from the main fuel pump 17 enters the housing 46 through the inlet 48. The inlet 48 leads to a fuel passage 50 within the housing 46. The fuel passage 50 leads to an inlet 52 of the secondary fuel pump 22, may also lead to an inlet 54 of a fuel pressure regulator 36, and leads to an outlet 56 from which fuel is discharged for delivery to an engine. In the area of the outlet 56, a seal 58 may be provided between the housing 46 and flange 28 to limit or prevent fuel leakage between them. The housing 46 may be formed from plastic or metal suitable for use with the fuel in the tank 12. The housing 46 may have a cylindrical boss 60 that is press-fit into a bore 62 open to the outlet 30 of the flange 28, and/or the housing 46 may include one or more snap-fit features that retain the housing to the flange. The outlet valve 38 may be carried by the housing 46, flange 28 or a component downstream thereof. The outlet valve 38 permits fuel flow therethrough and toward the engine, but prevents the opposite flow of fuel to maintain some pressure in the fuel system downstream of the valve, even when the main fuel pump 17 is not operating.

The housing fuel passage 50 may include a first branch passage that leads to the inlet 54 of the fuel pressure regulator 36. The fuel pressure regulator 36 may include an inlet formed in a flange 61 that is received within a pocket 63 formed in the housing 46, with a seal 65 between them. The pressure regulator 36 may be of any suitable construction and functions to permit fuel to be bypassed to the tank 12 or reservoir 18 via an outlet when the pressure of the fuel at the pressure regulator inlet 54 is above a threshold pressure. In this way, fuel downstream of the pressure regulator 36 is at or below a threshold pressure. In the implementation shown, the pressure regulator inlet 54 is downstream of the secondary fuel pump inlet 52 relative to the direction of fuel flow from the main fuel pump 17, although other arrangements are possible.

A second branch passage off the housing fuel passage 50 may lead to or define the inlet 52 of the secondary fuel pump 22. The secondary fuel pump 22 may include a nozzle 66 or other orifice and fuel that enters the inlet 52 is discharged generally along an axis 68 through the nozzle 66. Downstream of the nozzle 66, the secondary pump 22 may include a venturi tube 70 having a passage 72 extending from an inlet 74 to an outlet 75 and which is axially aligned with the nozzle 66 and through which flows the fuel discharged from the nozzle 66. While a venturi passage generally includes a restriction or narrowed portion, the venturi tube 70 could have a constant or diverging inner diameter. Of course, this may depend upon the operational parameters of the secondary fuel pump 22 and the reduced pressure needed for a particular application. The venturi tube 70 may be a separate component coupled to the housing 46, or it may be formed as an integral feature of the housing. While described as being axially aligned, the nozzle 66 and venturi tube 70 need not be perfectly coaxial, and they may be slightly offset and/or their axes might not be parallel. In the area of the outlet of the nozzle 66 and inlet 74 of the venturi tube 70, an opening 76 may be provided. The opening 76 defines at least part of an inlet of the secondary fuel pump 22 and may be formed within the housing 46 and it is communicated with one or more of the fuel pickups 26 via the conduits 44, which may be coupled at one end to the housing 46 such as at a nipple 78 (FIG. 5) formed on the housing 46.

Downstream of at least a portion of the venturi tube 70, a flow controller 80 may be provided. The flow controller 80 may include a wall 82 or surface that is inclined at an angle greater than zero relative to the axis 68 of the venturi tube 70 (and is shown as being generally perpendicular to the axis) and against which fuel discharged from the venturi is directed. In at least some operating conditions, the wall 82 will cause fuel to back up into the venturi tube 70 and help to ensure that at least a significant portion of the venturi tube 70 is wetted, which is to say covered or immersed in liquid fuel to prevent an air gap through the venturi tube 70 that would lessen the pressure drop and reduce the efficiency of the secondary pump 22. The wetted portion may include an entire section of the venturi tube taken along a plane extending through the venturi tube and intersecting the axis of the venturi tube. The flow controller 80 may be part of an adjacent component of the module 16, fuel tank 12 or other fuel system component, or it may be formed from a separate body 84 as is shown in FIGS. 2 and 3.

The flow controller body 84 may include an inlet 86, a chamber 88, defined in a tubular portion fitted over or generally aligned with the venturi tube 70, and an outlet 90 through which fuel is returned into the reservoir 18. The outlet 90 may direct the fuel upwardly (relative to the direction of gravity), out of the body 84, to increase the likelihood that the fuel will fill the flow controller chamber 88 and adjacent venturi tube 70. The body 84 may further include a connection feature 92 adapted to be coupled to or otherwise carried by the flange 28. In the implementation shown, the flange 28 includes a projection 94 and the connection feature 92 is a cylindrical wall that may be coupled to the projection. For example, without limitation, the projection 94 and connection feature 92 may include interconnecting features, like detents or outwardly extending barbs and openings to receive the barbs when the connection feature is pressed onto the projection. Of course, other features may be provided and the connection feature could be adhered, welded, press-fit or connected to the projection 94 by any suitable method or mechanism including by a separate component like a mechanical connector (e.g. staple, bolt, clip, etc). The outlet 90 may lead to a gap or gaps 96 between the connection feature 92 and projection 94 and fuel may flow back into the reservoir 18 through the gaps. In one implementation, the fuel discharged from the outlet 90 must flow upwards into and over the top of the connection feature 92 which is preferred to be located vertically above the venturi tube 70 (relative to the force of gravity) before fuel is returned to the reservoir 18. However, because of wall 82, the flow controller body 84 is functional in any orientation, which is to say that fuel will substantially fill the venturi in any or nearly any orientation if the flow rate out of the controller body is less than a threshold which may be a function of the flow rate through the venturi. This further ensures that the flow controller chamber 88 and at least a portion of the venturi tube 70 will be filled with fuel, under at least many operating conditions.

In at least certain implementations, the fuel may flow upwardly above the top of the venturi tube 70 between about 2 mm and 20 mm before the fuel leaves the flow controller body 84 and is returned to the reservoir interior 20. Further, the outlet 90 may be oriented vertically at or near the top of the body 84 so that fuel must fill the controller chamber 88 before exiting the controller 80. And the flow through the nozzle 66 may be between about 5 l/hr and 50 l/hr. The nozzle through hole diameter may be between 0.25 mm and 1.0 mm.

In use, the main fuel pump 17 takes in fuel from the reservoir 18 and discharges fuel under pressure through its outlet which is communicated with the passage 50 of the housing 46. From the passage inlet 48, the fuel flows to the branch passages leading to the secondary fuel pump 22 and the pressure regulator 36. If the fuel at the pressure regulator 36 is above a threshold pressure, some fuel is bypassed back to the interior 20 of the reservoir 18 where it is available to be taken in again by the main fuel pump 17. Fuel at or below the threshold pressure flows through the outlet valve 64 and out of the flange outlet 30 for delivery to the engine.

Fuel at the inlet of the secondary fuel pump 22 flows through the nozzle 66 and venturi tube 70. Fuel that exits the venturi tube 70 is directed to the flow controller 80 which is constructed to disrupt the flow and/or cause fuel to fill all or substantially all of the flow area of at least a portion of the axial length of the venturi tube 70. This prevents an air gap from forming within the venturi tube 70 which would diminish the pressure drop created by fuel flowing through the venturi tube 70. In this manner, the efficiency of the secondary fuel pump 22 is maintained high at a wider range of fuel flow rates into and through the venturi tube 70 to facilitate drawing fuel through the fuel pickups 26 and into the secondary fuel pump 22 through the connecting conduit 44. The fuel flow through the secondary pump 22 creates a decreased pressure in the area of the opening for the fuel pickups, which draws fuel from the tank through the fuel pickups. Fuel drawn through the fuel pickups 26 flows through the connecting conduit 44 and enters the housing 46 through the opening 76 whereupon that fuel flows through the venturi tube 70 along with the fuel flowing out of the nozzle 66. The combined fuel flows from the opening 76 and nozzle 66 flow through the venturi tube 70 and eventually is discharged from the flow controller 80 and into the reservoir interior 20 where it is available to be pumped by the main fuel pump 17.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A fuel pump assembly for a fuel tank with an interior, comprising:

a fuel pump having an inlet through which fuel enters the fuel pump and an outlet through which fuel is discharged under pressure for delivery to an engine;

a nozzle having an inlet in communication with the outlet of the fuel pump through which fuel is discharged under pressure so that at least some of the fuel under pressure discharged from the fuel pump outlet flows into the nozzle inlet, the nozzle also having an orifice through which fuel is ejected from the nozzle;

a venturi downstream of the nozzle and having an inlet through which fuel discharged from the orifice flows, a passage downstream of the inlet through which fuel flows to create a drop in pressure, and an outlet through which fuel is discharged from the venturi;

a mounting flange configured to be carried by the fuel tank and disposing the nozzle, orifice, venturi inlet, passage, and outlet in a top portion of the interior of the fuel tank;

a fuel inlet through which fuel is drawn from the fuel tank into the venturi passage by the drop in the pressure created in an area of the venturi;

a flow controller downstream of the venturi outlet and having an inlet into which at least some of the fuel discharged from the venturi outlet is directed, an outlet, and an inclined surface oriented at an angle between 10 degrees and 90 degrees relative to a direction of fuel flow through the venturi outlet to direct fuel to the outlet of the flow controller;

the outlet of the flow controller is disposed above the venturi outlet relative to the direction of gravity so that fuel exits the flow controller outlet at a location above the outlet of the venturi passage to thereby improve the pressure drop generated in the area of the venturi;

a fuel reservoir in the interior of the fuel tank and having an interval volume; and the fuel pump inlet communicating with the internal volume of the fuel reservoir and the outlet of the flow controller communicating with the internal volume of the fuel reservoir adjacent the top portion of the fuel tank, wherein the fuel reservoir is coupled to the mounting flange and wherein the nozzle, venturi and flow controller are carried by the mounting flange separately from the fuel reservoir and located within the internal volume of the fuel reservoir.

2. The fuel pump assembly of claim 1 wherein a flow rate of fuel through the flow controller outlet is low enough to permit the venturi to be filled with fuel in any orientation of the flow controller outlet.

3. The fuel pump assembly of claim 1 wherein the venturi is configured to communicate with the fuel tank through the fuel inlet and fuel discharged from the venturi flows into the internal volume of the reservoir.

4. The fuel pump assembly of claim 3 wherein the mounting flange is coupled to the reservoir, and the flow controller includes a connection feature coupled to the mounting flange.

5. The fuel pump assembly of claim 4 wherein the outlet of the flow controller is defined by one or more gaps between the flow controller and the mounting flange so that fuel exits the flow controller between the flow controller and the mounting flange and enters the reservoir internal volume.

6. The fuel pump assembly of claim 1 wherein the flow controller includes a chamber aligned with the venturi passage and the inclined surface defines part of the chamber.

7. The fuel pump assembly of claim 6 wherein a flow of fuel against the inclined surface causes fuel to fill the chamber to fully wet the venturi passage and prevent an air gap through the venturi passage.

8. The fuel pump assembly of claim 6 wherein the outlet of the flow controller is located between 2 mm and 20 mm above a top of the venturi passage.

9. The fuel pump assembly of claim 1 wherein the outlet of the flow controller is defined by one or more gaps between the flow controller and the mounting flange so that fuel exits the flow controller between the flow controller and the mounting flange and enters a reservoir internal volume.

10. The fuel pump assembly of claim 1 wherein when a flow rate out of the nozzle orifice reaches 5 liters per hour, fuel in the flow controller fully wets the outlet of the venturi.

11. The fuel pump assembly of claim 1 wherein the venturi passage is elongate and configured with an axis which is perpendicular to a force of gravity acting on fuel in the venturi passage.

12. The fuel pump assembly of claim 1 which also includes a housing that is carried by or formed in one-piece with the mounting flange, and wherein at least one of the nozzle, venturi and flow controller is carried by the housing separately from the fuel reservoir.

13. The fuel pump assembly of claim 12 wherein the housing includes an inlet that is coupled to the outlet of the fuel pump, and a fuel passage that communicates with the housing inlet and with the nozzle, and wherein the nozzle is fixed to the housing.

14. The fuel pump assembly of claim 12 wherein the nozzle is coupled to the housing, the venturi is coupled to the housing, and the flow controller is coupled to the venturi and the mounting flange.

15. A fuel pump assembly for a fuel tank with an interior, comprising:

a fuel pump having an inlet through which fuel enters the fuel pump and an outlet through which fuel is discharged under pressure for delivery to an engine;

a nozzle having an inlet in communication with the outlet of the fuel pump and an orifice through which fuel is ejected from the nozzle;

a venturi downstream of the nozzle and having an inlet through which fuel discharged from the orifice flows, a passage downstream of the inlet through which fuel flows to create a drop in pressure, and an outlet through which fuel is discharged from the venturi;

a mounting flange configured to be carried by the fuel tank and disposing the nozzle, orifice, venturi inlet, passage, and outlet in a top portion of the interior of the fuel tank;

a fuel inlet through which fuel is drawn from the fuel tank into the venturi passage;

a flow controller downstream of the venturi outlet and having an inlet into which at least some of the fuel discharged from the venturi outlet is directed, an outlet, and an inclined surface oriented at an angle between 10 degrees and 90 degrees relative to a direction of fuel flow through the venturi outlet to direct fuel to the outlet of the flow controller, the outlet of the flow controller is disposed above the venturi outlet relative to the direction of gravity so that fuel exits the flow controller outlet at a location above the outlet of the venturi passage;

a fuel reservoir in the interior of the fuel tank and having an interval volume; and the fuel pump inlet communicating with the internal volume of the fuel reservoir and the outlet of the flow controller communicating with the internal volume of the fuel reservoir adjacent the top portion of the fuel tank, wherein the fuel reservoir is coupled to the mounting flange and wherein at least one of the nozzle, venturi and flow controller are carried by the mounting flange separately from the fuel reservoir and located within the internal volume of the fuel reservoir.

* * * * *